US006446706B1

(12) United States Patent
Rosenfeld et al.

(10) Patent No.: US 6,446,706 B1
(45) Date of Patent: Sep. 10, 2002

(54) FLEXIBLE HEAT PIPE

(75) Inventors: John H. Rosenfeld, Lancaster; Nelson J. Gernert; David B. Sarraf, both of Elizabethtown; Peter Wollen, Lititz; Frank Surina, Willow Street, all of PA (US); John Fale, Sartell, MN (US)

(73) Assignee: Thermal Corp., Stanton, DE (US)

( * ) Notice: Subject to any disclaimer, the term of this patent is extended or adjusted under 35 U.S.C. 154(b) by 0 days.

(21) Appl. No.: 09/625,301

(22) Filed: Jul. 25, 2000

(51) Int. Cl.[7] ..... F28F 7/00

(52) U.S. Cl. ..... 165/46; 165/104.26; 165/905

(58) Field of Search ..... 165/46, 911, 104.26, 165/907, 104.33, 905, 185, 906; 361/700; 257/715; 174/15.2

(56) References Cited

U.S. PATENT DOCUMENTS

| | | | | | |
|---|---|---|---|---|---|
| 3,576,210 | A | * | 4/1971 | Trent | 165/104.26 |
| 3,604,503 | A | * | 9/1971 | Feldman, Jr. | 165/46 |
| 3,738,702 | A | | 6/1973 | Jacobs | 165/45 |
| 3,789,920 | A | * | 2/1974 | Low et al. | 165/104.26 |
| 3,820,596 | A | * | 6/1974 | Weinhardt et al. | 165/104.26 |
| 3,834,457 | A | * | 9/1974 | Madsen | 165/104.26 |
| 4,043,387 | A | * | 8/1977 | Lamp | 165/104.26 |
| 4,109,709 | A | * | 8/1978 | Honda et al. | 165/104.26 |
| 4,212,347 | A | * | 7/1980 | Eastman | 165/86 |
| 4,279,294 | A | | 7/1981 | Fitzpatrick et al. | 165/45 |
| 4,563,315 | A | * | 1/1986 | Ulrich | 165/46 |
| 4,830,097 | A | * | 5/1989 | Tanzer | 165/104.26 X |
| 4,842,045 | A | | 6/1989 | Reinmuller | 165/41 |
| 4,953,632 | A | * | 9/1990 | Sakaya et al. | 165/104.26 |
| 4,997,032 | A | | 3/1991 | Danielson et al. | 165/46 |
| 5,201,196 | A | * | 4/1993 | Faghri | 165/104.26 |
| 5,343,940 | A | | 9/1994 | Jean | 165/104.33 |
| 5,485,671 | A | | 1/1996 | Larson et al. | 165/104.19 |
| 5,560,423 | A | | 10/1996 | Larson et al. | 165/104.26 |
| 5,603,375 | A | * | 2/1997 | Salt | 165/104.26 |
| 5,642,776 | A | | 7/1997 | Meyer, IV et al. | 165/104.26 |

FOREIGN PATENT DOCUMENTS

| | | | | |
|---|---|---|---|---|
| DE | 2913472 | * | 10/1980 | 165/46 |
| DE | 3040986 | * | 6/1982 | 165/46 |
| GB | 2093981 | * | 9/1982 | 165/46 |
| JP | 0175888 | * | 10/1982 | 165/104.26 |
| JP | 0110991 | * | 2/1983 | 165/104.26 |
| JP | 0195792 | * | 11/1983 | 165/46 |
| JP | 61029160 | * | 2/1986 | |
| SU | 1108323 | * | 8/1984 | 165/46 |
| SU | 001673824 | * | 8/1991 | 165/104.26 |

OTHER PUBLICATIONS

Cooling Packet for Electronic Components, p. 263, May 1988.*

* cited by examiner

*Primary Examiner*—Christopher Atkinson
(74) *Attorney, Agent, or Firm*—Duane Morris LLP

(57) ABSTRACT

The invention is a very flexible heat pipe which is constructed of multiple layers of material laminated into the final structure. The center of the symmetrical structure is a coarse screen which creates a vapor space. The layers on either side of the screen are copper felt pads, and the outer casing is two layers of metal foil and a layer of polypropylene. The heat pipe constructed in this manner is so a flexible that when one outside surface is covered with adhesive, the heat pipe can essentially be used as tape or a stick-on heat transfer surface which conforms to a body being cooled.

25 Claims, 2 Drawing Sheets

FLEXIBLE HEAT PIPE

BACKGROUND OF THE INVENTION

This invention deals generally with heat pipes and more specifically with the structure of a highly flexible heat pipe.

Traditional heat pipes are constructed with rigid metal casings and internal sintered wicks which, after manufacture, are expected to remain essentially in the same configuration as they were originally manufactured. Some such heat pipes have been constructed with thin casings to permit some reconfiguration, and there have been a number of patents for heat pipes which include flexible segments to enable repeated bending of certain parts of the heat pipe.

There are also a number of patents which have issued for heat pipes which are considered to be flexible in that their entire casings are constructed of thin flexible materials, and some of these patents include wicks which are also flexible. U.S. Pat. No. 5,560,423 by Larson et al discloses a flexible heat pipe with a thin metal sheet for one side of the casing and a thin plastic sheet for the other, with sheet screen wicking between them. U.S. Pat. No. 5,343,940 by Jean forms a flexible reheat pipe of laminated plastic material and keeps the surfaces so close together that the vapor space also acts as a capillary structure. Reinmuller (U.S. Pat. No. 4,842,045) suggests metal and elastomer composites among other materials for the envelope of a flexible condenser, but mentions no wick, and Fitzpatrick et al (U.S. Pat. No. 4,279,294) discloses flexible heat pipe bags with metal filled plastic and other materials used for the envelope and with a wick of fiberglass.

Nevertheless, none of these prior art patents address two significant problems with heat pipes. The first problem is ease of manufacture, without which a flexible heat pipe essentially remains a laboratory curiosity. The second problem is actually more significant, because it causes gradual deterioration of the vacuum within a heat pipe and therefore decreases the heat pipe's useful life. Virtually every known H plastic is to some extent actually permeable to gas, particularly to hydrogen and helium. In most applications this has no significance whatsoever, but in heat pipes with thin plastic sheet casings and because of the very low internal pressure when a heat pipe is not operating, non-condensible gases do permeate into the heat pipe. It is the accumulation of non-condensible gases that eventually makes the heat pipe inoperable.

It would be very advantageous to have a truly flexible thin heat pipe which was not susceptible to permeation of gas into its casing and was flexible enough to actually wrap around small objects to cool them. An even more advantageous configuration for a heat pipe would be a continuous length of highly flexible, flat heat pipe with an adhesive preapplied to one outside surface and seals between sections at a regular intervals. Such a structure would, for all intents and purposes, be a heat pipe in the form of a length of tape.

SUMMARY OF THE INVENTION

The present invention is essentially a very thin and very flexible heat pipe which, when coated with adhesive on one outside surface, can be used as if it were tape. That means, for instance, that if an integrated circuit requires cooling, the heat pipe can be adhered to the integrated circuit and to a remote heat sink, and the heat from the integrated circuit will be efficiently transferred to the heat sink even if the heat sink is on a panel which is moveable relative to the integrated circuit.

The preferred embodiment of the heat pipe of the present invention is only about 0.120 inch thick, and it comprises five major layers. The central layer is a coarse screen which acts as a separator to establish the heat pipe vapor space by separating two layers of copper felt wick, one on each side of it the screen layer. The other two layers, which are sealed together around their edges, form the envelope of the heat pipe around the wick and the separator, and the envelope walls are themselves composed of multiple layers of metal, adhesive, and plastic.

The two envelope walls of the preferred embodiment start with an inside layer of polypropylene which acts as a heat activated bonding agent. That is, when the edges of two envelope walls are pressed together and heat is applied, the two envelope walls seal together because their inner layers of if polypropylene bond together. The next layer of the envelope walls is a very thin layer of polyethylene terepthalate. This material acts as an adhesive to bond the next layer of copper foil to the previous polypropylene layer. Then there is another layer of polyethylene terepthalate adhesive and another layer of copper foil on the outside of the envelope. Other layers can also be added for particular applications. For instance a tedlar layer can be used to furnish better external abrasion resistance, or an adhesive layer can be added to aid in attachment and installation of the heat pipe.

The two copper foil layers are used to improve the reliability and life expectancy of the heat pipe, and yield better results than a single layer with a thickness equal to the total of the two layers. Based on the understanding that all foil layers have occasional and random pinholes in the original sheets, the use of two layers reduces the likelihood of vacuum leaks because of the very low probability that two such pinholes in separate sheets of foil will actually align in A the final structure. Additionally, bonding of plastic layers to both sides and between the metal foil layers reduces the likelihood of stress concentrations and resultant pinhole formation through the metal foil layers.

The flexible heat pipe of the invention thereby has a reliably leak tight envelope even though the thickness of each wall of the envelope is less than 0.010 inch. Those thin walls along with two copper felt wicks of only 0.10 to 0.040 inch thickness and the coarse polypropylene separator screen about 0.040 inch thick permit the structure to be extremely flexible and yet, when loaded with a suitable fluid, function as a very efficient heat pipe.

DETAILED DESCRIPTION OF THE INVENTION

Figure 1:
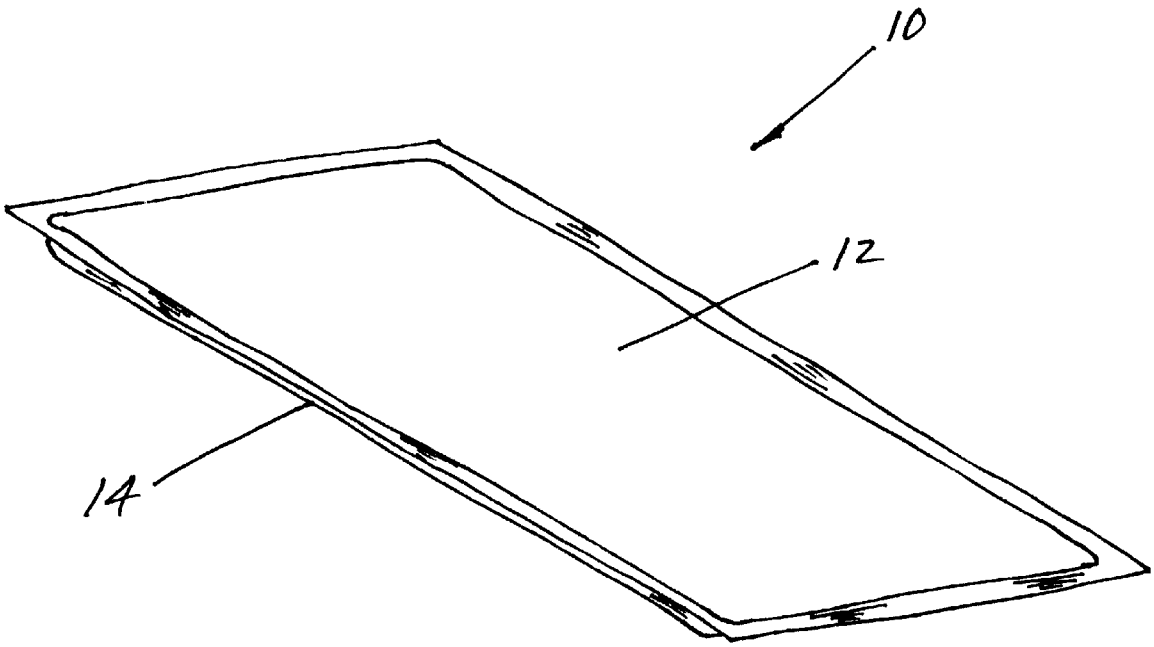
FIG. 1 is a perspective external view of a heat pipe of the a preferred embodiment.

FIG. 1 is a perspective external view of heat pipe 10 of the preferred embodiment which provides some indication of the heat pipe's very small total thickness, which is typically less than 0.120 inch. In the external view of FIG. 1 only outer laminate layers 12 and 14 of copper foil can be seen, although bottom layer 14 can also be coated with a nearly invisible layer of adhesive or abrasion resistant material as shown in FIG. 2.

Figure 2:
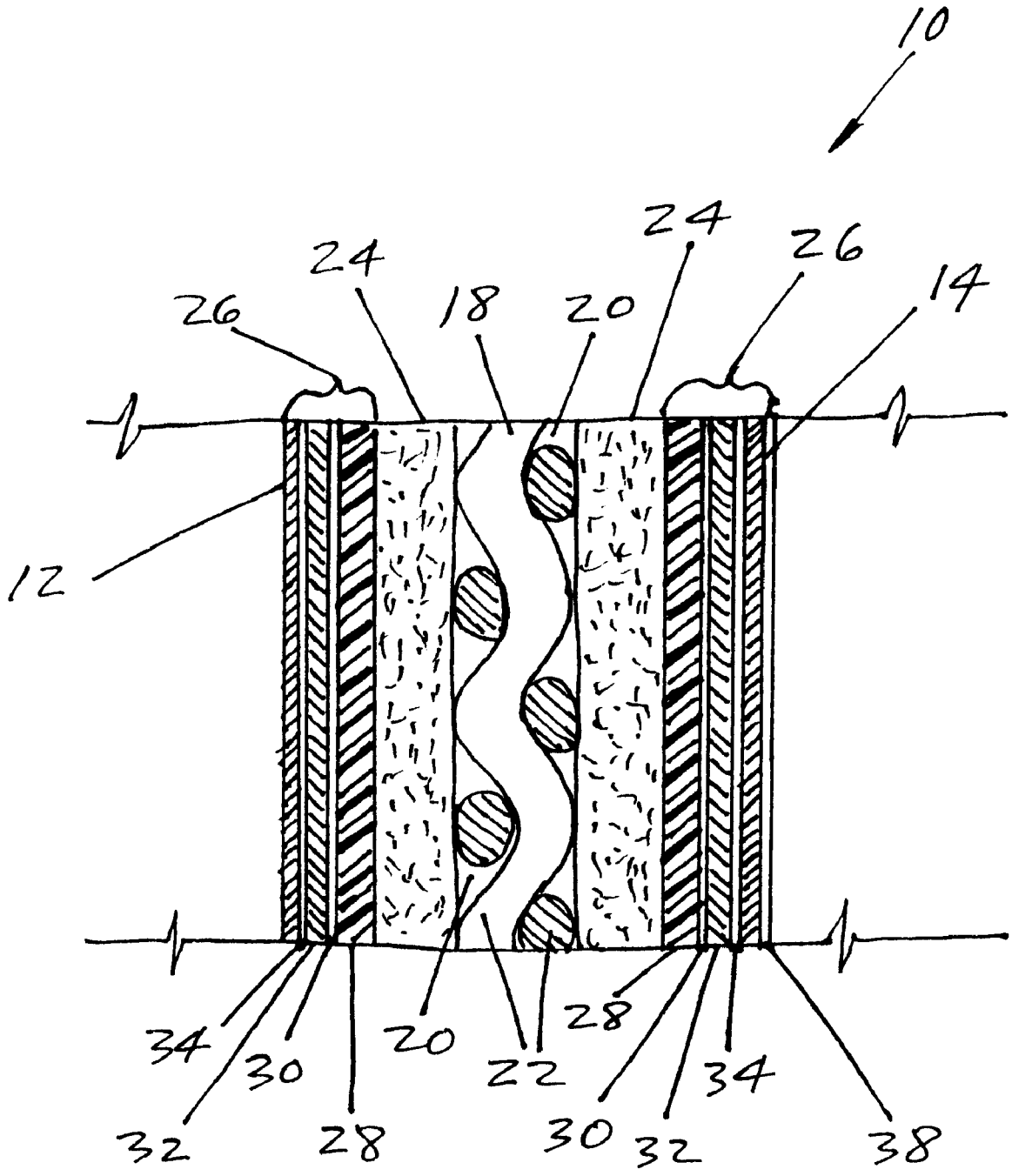
FIG. 2 is an enlarged cross section view of a part of the heat pipe of the preferred embodiment.

FIG. 2 is an enlarged cross section view of a short length of heat pipe 10 of the preferred embodiment in which the multiple layers are shown, although the thicknesses of the layers are not shown in true scale.

Separator 18 is located at the center of heat pipe 10. Separator 18 is constructed of one or more layers of either metal or plastic screen, although plastic screen makes heat pipe 10 somewhat more flexible, and a coarse porous metal felt material may also be used as a vapor spacer. The function of separator 18 is to provide interconnected spaces 20 within heat pipe 10 to function as the vapor space within which vapor evaporated at a heat input point can migrate to cooler parts of heat pipe 10 to be condensed. In the preferred embodiment, separator 18 is formed of 10 mesh polypropylene screen with 0.030 inch wire thickness, although screen in the range of 10 to 50 mesh is satisfactory. Since wires 22 of separator 18 overlap and contact each other, the screen of the preferred embodiment provides a minimum separation of about 0.040 inch between the wick layers 24 on either side of separator 18.

Wick layers 24 are each conventional copper felt wick which is in the range of 0.010 to 0.040 inch thick. This felt is typically constructed of fibers which are 20 microinches in diameter and 0.20 inch long, and copper fills 20 to 60 percent of the wick volume. Wick layers 24 are held in place by a partial vacuum when the heat pipe is operating below the working fluid's normal boiling point. It is also possible to melt or press the wick layers into the inner polypropylene layers of the laminate wall, thereby improving the thermal conductance between the wall and the adjoining wick. One or more layers of fine mesh screen can also serve as wick layers.

Outer walls 26, which enclose separator 18 and wick layers 24, are themselves constructed of multiple layers. In the preferred embodiment shown in FIG. 2, the innermost layer of each outer wall 26 is polypropylene layer 28 which is 0.004 inch thick. Polypropylene layer 28 functions both to support thin metal foil layers 32, 12, and 14 which are in each outer wall 26 and to bond the two outer walls 26 together to form heat pipe 10. The bond is accomplished by pressing the edges of outer walls 26 together while heat is applied. This process is well known in the art of bonding plastics.

Inner metal foil layer 32 is attached to polypropylene layer 28 by the use of first adhesive layer 30. In the preferred embodiment, inner metal foil layer 32 is copper foil which is only 0.001 inch thick,.and first adhesive layer 30 is at typically 0.0005 inch thick and of polyethylene terepthalate.

Outer metal foil layers 12 and 14 are then attached to inner metal foil layer 32 by second adhesive layer 34 which is located between the two metal foil layers. In the preferred embodiment, outer metal foil layers 12 and 14 are the same material and size as first metal foil layers 32, and second adhesive layer 34 is the same as first adhesive layer 30.

The two metal foil layers in each wall are actually the barriers to protect from gas leakage into the interior vacuum of the heat pipe from the surrounding atmosphere when the heat pipe is not operating. The metal foil also serves to prevent the heat pipe's interior vapor pressure during operation from leaking out. While it is conventional to use metal casings to seal heat pipes from leakage, the reliability of such a barrier when it is foil is greatly enhanced by the use of two separate layers as opposed to a single layer. Since foil sheets have occasional and random pinholes through the foil, the use of two layers reduces the likelihood of leaks because of the very low probability that two such pinholes in separate sheets of foil will actually align in the final structure.

With a heat pipe envelope as described above, additional coatings can be applied to either or both outer metal foil layers 12 and 14 to facilitate various applications. For example, in some applications it may be desirable to coat the metal foil with an electrical insulating layer to prevent the heat pipe from creating shorts across adjacent electrical connectors or with a tedlar abrasion resistant layer. Adhesive layer 38 is shown on foil layer 14 particularly because it is advantageous to coat one outside layer of heat pipe 10 with an adhesive to make installation of the heat pipe much easier.

Thus, the use of two metal foil layers and a strengthening thicker plastic layer for support produces a very reliable and very flexible heat pipe envelope. Furthermore, placing a layer of adhesive on the heat pipe makes it possible for the end user to install the heat pipe on a device which requires cooling by merely pressing the heat pipe into place.

It is to be understood that the form of this invention go as shown is merely a preferred embodiment. Various changes may be made in the function and arrangement of parts; equivalent means may be substituted for those illustrated and described; and certain features may be used independently from others without departing from the spirit and scope of the invention as defined in the following claims. For example, aluminum foil may also be used for foil layers 32, 12, and 14, and adhesives other than polyethylene terepthalate could be used between layers. Moreover, coatings to increase the radiation cooling or abrasion resistance can be placed on the outside foil layers instead of adhesive layer 38.

What is claimed as new and for which Letters Patent of the United States are desired to be secured is:

1. A flexible heat pipe comprising:

a separator comprising at least one flexible layer with holes for multidirectional movement of vapor;

wick layers in contact with and located on both sides of the separator, with the wick layers comprising flexible porous material; and two outer walls enclosing the separator and the wick layers, with the outer walls in contact with the surfaces of the wick layers which are opposite from the separator, the edges of the outer walls bonded together, and the outer walls comprising:

first layer of metal foil; and a second layer of metal foil bonded to the first layer of metal foil wherein each metal foil layer is less than 0.010 inches thick.

2. The heat pipe of claim 1 wherein the outer walls further include a layer of plastic bonded to one of the layers of metal foil and the thickness of the plastic is sufficient to support multiple layers in the outer walls.

3. The heat pipe of claim 1 wherein the outer walls further include an inner layer of plastic of a thickness sufficient to act as a bonding agent between the outer walls when they are pressed together and subjected to heat.

4. The heat pipe of claim 1 wherein the wick layers are metal felt.

5. The heat pipe of claim 1 wherein the wick layers are screen.

6. The heat pipe of claim 1 wherein the separator is at least one layer of screen.

7. The heat pipe of claim 1 wherein the separator is at least one layer of polypropylene screen.

8. The heat pipe of claim 1 wherein the separator is screen in the range of 10 to 50 mesh.

9. The heat pipe of claim 1 wherein the layers of metal foil are copper.

10. The heat pipe of claim 1 wherein the layers of metal foil are copper of 0.001 inch thickness.

11. The heat pipe of claim 2 wherein the layer of plastic is polypropylene.

12. The heat pipe of claim 3 wherein the inner layer is polypropylene.

13. The heat pipe of claim 1 wherein layers are bonded together by intermediate layers of polyethylene terepthalate.

14. A flexible heat pipe comprising:

a flexible separator having a first side surface and a second side surface;

two flexible wicks, one located adjacent to said first side surface and one located adjacent to said second side surface; and a flexible first wall having a peripheral edge and a flexible second wall having a peripheral edge wherein said first wall and said second wall are each less than 0.010 inches thick and arranged so as to enclose said flexible separator and said two flexible wicks with said peripheral edges of said first and second walls being bonded together, and further wherein said first wall comprises a first layer of metal foil bonded to a second layer of metal foil and said second wall comprises a first layer of metal foil bonded to a second layer of metal foil.

15. The heat pipe of claim 14 wherein said flexible first and second walls further include a layer of plastic bonded to at least one of the layers of metal foil.

16. The heat pipe of claim 15 wherein said layer of plastic comprises a thickness sufficient to support multiple layers in said flexible first and second walls.

17. The heat pipe of claim 14 wherein said flexible first and second walls further. include an inner layer of plastic having a thickness sufficient to bond said flexible first and second walls when they are pressed together and subjected to heat.

18. The heat pipe of claim 14 wherein each of said two flexible wicks comprise metal felt.

19. The heat pipe of claim 14 wherein each of said two flexible wicks comprise screen.

20. The heat pipe of claim 14 wherein said flexible separator comprises at least one screen.

21. The heat pipe of claim 20 wherein said flexible separator comprises at least on e layer of polypropylene screen.

22. A flexible heat pipe comprising:

a screen having a first side surface and a second side surface;

two flexible wicks, one located adjacent to said first side surface and one located adjacent to said second side surface; and a flexible first wall having a peripheral edge and a flexible second wall having a peripheral edge wherein said first wall and said second wall are each less than 0.010 inches thick and arranged so as to enclose said screen and said two flexible wicks with said peripheral. edges of said first and second walls being bonded together, and further wherein said first wall comprises at least a first layer of metal foil bonded to at least a second layer of metal foil and said second wall comprises at least a first layer of metal foil bonded to at least a second layer of metal foil.

23. A flexible heat pipe comprising:

a flexible separator having a first side surface and a second side surface;

two felt wicks, one located adjacent to said first side surface and one located adjacent to said second side surface;

a flexible first wall having a peripheral edge and a flexible second wall having a peripheral edge and an outer surface, wherein said flexible first wall and said flexible second wall are each less than 0.010 inches thick and arranged so as to enclose said flexible separator and said two flexible wicks with said peripheral edges of said flexible first and second walls being bonded together, and further wherein said flexible first wall comprises a first layer of metal foil bonded to a second layer of metal foil and said flexible second wall comprises a first layer of metal foil bonded to a second layer of metal foil; and an adhesive layer applied to said outer surface of said second wall.

24. A flexible heat pipe comprising:

a course mesh screen having a first side surface and a second side surface;

two fine mesh screens, one located adjacent to said first side surface and one located adjacent to said second side surface; and a flexible first wall having a peripheral edge and a flexible second wall having a peripheral edge wherein said first wall and said second wall are arranged so as to enclose said course mesh screen and said two fine mesh screens with said peripheral edges of said first and second walls being bonded together, and further wherein said first wall comprises at least a first layer of metal foil bonded to at least a second layer of metal foil and said second wall comprises at least a first layer of metal foil bonded to at least a second layer of metal foil wherein each metal foil layer comprises a thickness less than 0.010 inches.

25. A flexible heat pipe comprising:

a course mesh screen having a first side surface and a second side surface;

two fine mesh screens, one located adjacent to said first side surface of said course mesh screen and one located adjacent to said second side surface of said course mesh screen; and a flexible first wall having a peripheral edge and a flexible second wall having a peripheral edge and an outer surface wherein said first wall and said second wall are each less than 0.010 inches thick and arranged so as to enclose said course mesh screen and said two fine mash screens with said peripheral edges of said first and second walls being bonded together, and further wherein said first wall comprises at least a first layer of metal foil bonded to at least a second layer of metal foil and said second wall comprises at least a first layer of metal foil bonded to at least a second layer of metal foil; and an adhesive layer applied to said outer surface of said second wall.

* * * * *